US008480549B1

(12) United States Patent
Hinds et al.

(10) Patent No.: US 8,480,549 B1
(45) Date of Patent: Jul. 9, 2013

(54) VERSATILE EXERCISE BARS AND HANDLES

(75) Inventors: Robert S. Hinds, Madison, WI (US); Glenn Polinsky, Waunakee, WI (US); Ray Rollins, Verona, WI (US); John Stephenson, Madison, WI (US); Brandon Grayson Hall, Stoughton, WI (US); Doug J. Birkholz, Madison, WI (US); Leslie A. Wagner, Mukwonago, WI (US)

(73) Assignee: Robert S. Hinds, Madison, WI (US)

( * ) Notice: Subject to any disclaimer, the term of this patent is extended or adjusted under 35 U.S.C. 154(b) by 0 days.

(21) Appl. No.: 13/423,857

(22) Filed: Mar. 19, 2012

Related U.S. Application Data

(60) Provisional application No. 61/454,104, filed on Mar. 18, 2011.

(51) Int. Cl.

| | |
|---|---|
| ***A63B 7/00*** | (2006.01) |
| ***A63B 21/00*** | (2006.01) |
| ***A63B 21/02*** | (2006.01) |
| ***A63B 21/04*** | (2006.01) |
| ***A63B 21/068*** | (2006.01) |

(52) U.S. Cl.
USPC ..... 482/143; 482/121; 482/129; 482/131; 482/38; 482/39

(58) Field of Classification Search
USPC ..... 482/91, 92, 95, 96, 121, 122, 125, 482/124, 126, 129, 130, 131, 143
See application file for complete search history.

(56) References Cited

U.S. PATENT DOCUMENTS

| | | | | |
|---|---|---|---|---|
| 3,117,781 | A | 1/1964 | Vargo et al. | |
| 3,256,015 | A | 6/1966 | Perrin et al. | |
| 3,355,171 | A | 11/1967 | Oesau et al. | |
| 4,059,265 | A | 11/1977 | Wieder et al. | |
| 4,195,835 | A | 4/1980 | Hinds et al. | |
| 4,304,402 | A | 12/1981 | Ripp | |
| 4,316,610 | A | 2/1982 | Hinds | |
| 4,326,708 | A | 4/1982 | Hinds | |
| 4,328,964 | A | 5/1982 | Walls | |
| 4,518,162 | A | 5/1985 | Oates | |
| 4,779,867 | A | 10/1988 | Hinds | |
| 5,102,124 | A * | 4/1992 | Diodati | 482/107 |
| 5,125,649 | A | 6/1992 | Fuller | |
| 5,131,650 | A | 7/1992 | Hall | |
| 5,190,512 | A | 3/1993 | Curran | |

(Continued)

FOREIGN PATENT DOCUMENTS

| | | | |
|---|---|---|---|
| DE | 202 12 470 | U1 | 2/2003 |
| WO | WO 89/10773 | A1 | 11/1989 |
| WO | WO 2008/011544 | A2 | 1/2008 |

*Primary Examiner* — Loan Thanh
*Assistant Examiner* — Sundhara Ganesan
(74) *Attorney, Agent, or Firm* — Craig A. Fieschko, Esq.; DeWitt Ross & Stevens S.G.

(57) ABSTRACT

An exercise bar is configured to removably receive elastic lines, allowing its use in elastic resistance exercises, and/or inelastic lines, allowing its use in suspended bodyweight exercises. Separate grips, each being engageable by a hand or a foot, are also provided, and may be removably connected to the bar or to each other via one or more lines. Bar supports may also be provided to support the bar above the ground, allowing easy use of the bar to perform push-ups and other exercises.

26 Claims, 2 Drawing Sheets

U.S. PATENT DOCUMENTS 5,205,802 A * 4/1993 Swisher ..... 482/141
5,478,297 A 12/1995 Dennis, Jr.
5,505,677 A * 4/1996 Hinds ..... 482/10
5,549,532 A 8/1996 Kropp
5,571,064 A 11/1996 Holm
5,746,687 A 5/1998 Vial et al.
5,885,196 A 3/1999 Gvoich
6,018,894 A 2/2000 Whitehead et al.
6,402,668 B1 6/2002 Harker
6,497,641 B1 12/2002 Hinds
6,554,152 B2 4/2003 Smith
6,648,821 B2 11/2003 Lebel et al.
6,692,415 B1 2/2004 Winston
6,860,841 B1 3/2005 Mortorano
6,923,750 B1 * 8/2005 Hinds ..... 482/126
6,979,286 B1 12/2005 Hinds
6,988,978 B1 1/2006 Nault et al.
7,044,896 B2 * 5/2006 Hetrick ..... 482/95
7,357,762 B1 4/2008 Terry et al.
7,470,224 B1 12/2008 Everett
7,578,775 B2 8/2009 Terry
8,057,371 B2 * 11/2011 Mcbride et al. ..... 482/142
8,075,461 B2 12/2011 Terry et al.
2002/0052270 A1 5/2002 Hinds
2002/0137609 A1 * 9/2002 Rosati ..... 482/126
2005/0209069 A1 * 9/2005 Biernacki ..... 482/96
2005/0255976 A1 * 11/2005 Hinds et al. ..... 482/126
2007/0173387 A1 7/2007 Wu
2009/0253557 A1 10/2009 Klein
2010/0113235 A1 * 5/2010 Calvagne et al. ..... 482/143
2010/0152002 A1 * 6/2010 Knight ..... 482/93

* cited by examiner

VERSATILE EXERCISE BARS AND HANDLES

CROSS-REFERENCE TO RELATED APPLICATIONS

This application claims priority under 35 USC §119(e) to U.S. Provisional Patent Application 61/454,104 filed Mar. 18, 2011, the entirety of which is incorporated by reference herein.

FIELD OF THE INVENTION

This document concerns an invention relating generally to fitness and exercise equipment, and more specifically to equipment utilizing bars and/or handles in combination with elastic and/or inelastic lines, whereby a user can grasp the bar and/or handles and work against the lines to exercise his or her muscles.

BACKGROUND OF THE INVENTION

In the exercise and fitness fields, elastic resistance exercise equipment—e.g., an exercise bar which may be gripped by a user, and which is affixed to one or more springs, elastic cables, or other elastic members to offer resistance to motion of the bar (e.g., in the nature of the bar of a barbell)—is a popular fitness tool. Examples of exercise bars which engage to elongated elastic members to provide resistance to bar motion can be seen in, for example, U.S. Pat. No. 4,326,708 to Hinds, U.S. Pat. No. 4,779,867 to Hinds, U.S. Pat. No. 5,131,650 to Hall, U.S. Pat. No. 6,402,668 to Harker, U.S. Pat. No. 6,979,286 to Hinds et al., U.S. Pat. No. 7,578,775 to Terry, and U.S. Pat. No. 8,075,461 to Terry. Some of these patents also illustrate elastic resistance exercise equipment using elastically-tethered handles, elastically-tethered bands which engage arms, legs, waists, etc., and other elastically restrained components, and further examples can be found (for example) in U.S. Pat. No. 5,125,649 to Fuller and U.S. Pat. No. 5,885,196 to Gvoich. Many of the devices shown in the aforementioned patents are advantageously of rather compact and light-weight construction, such that the devices can fairly readily be disassembled, transported, and then assembled elsewhere for subsequent use.

Suspended bodyweight exercise equipment—i.e., equipment which suspends some or all of a user's body above the ground, and allows them to work against their own body weight—is also popular, and tends to be relatively light-weight and portable. Examples of suspended bodyweight exercise devices can be seen, for example, in U.S. Pat. No. 5,944,640 to Larsson, U.S. Pat. No. 6,921,354 to Shifferaw, U.S. Pat. No. 7,438,674 to Sjodin, U.S. Pat. No. 7,892,157 to Arnett, and U.S. Pat. No. 7,651,448 to Hetrick. Such devices equipment usefully allow easy variation in the amount of resistance encountered by users, with a user often being able to vary resistance from almost no resistance, to almost all of the weight of his/her body. In contrast, the resistance offered by elastic resistance exercise equipment can be restricted to the predefined elasticities of the elastic members provided with the elastic resistance exercise equipment. However, suspended bodyweight exercise equipment is not as readily usable as elastic resistance exercise equipment owing to its need for some sturdy structure to which the suspended bodyweight exercise equipment must be anchored, e.g., a doorframe, overhead bar, tree branch, etc.

Owing to the respective advantages and disadvantages of elastic resistance exercise equipment and suspended bodyweight exercise equipment, it would be beneficial to have equipment available which readily allows both types of exercise. Some prior equipment of this nature is available, e.g., that of U.S. Pat. No. 6,652,419 to Rota, but this equipment is not very versatile, and allows only limited types of exercise, and it is not easily disassembled, transported, and reassembled. It would also be useful to have equipment available—whether it be elastic resistance exercise equipment, suspended bodyweight exercise equipment, or both—which may be readily reconfigured to allow a greater range of types of exercise.

SUMMARY OF THE INVENTION

The invention, which is defined by the claims set forth at the end of this document, is directed to versatile exercise devices which can at least partially address the issues discussed above. A basic understanding of some of the features of exemplary versions of the invention can be attained from a review of the following brief summary of the invention, with more details being provided elsewhere in this document. To assist in the reader's understanding, the following review makes reference to the accompanying drawings (which are briefly reviewed in the "Brief Description of the Drawings" section following this Summary section of this document).

Referring to FIG. 1, an exemplary version of the invention is shown in partially disassembled form. Following is a brief introduction to the depicted components, with further details on their preferred structure, function, and interaction being provided thereafter:

(1) An elongated exercise bar 100 formed as a pair of bar sections 102 with a bar section connector 104, wherein the bar sections 102 may be joined by the connector 104 to define a bar 100 which can be readily disassembled for transport and storage. The bar 100 has bar ends 106 with elongated bar strap slots 108 defined therein which are configured to removably receive portions of the lengths of the elongated straps 200 discussed below. Bar end caps 110 are also shown attached to, or ready to attach to, the bar ends 106, and these have cap strap slots 112 (seen at the bar end cap 110 at the right side of FIG. 1) which are situated in adjacent alignment with the bar strap slots 108 when the bar end caps 110 are on the bar ends 106. The bar end caps 110 also each include a line slot 114 defined therein (shown in greater detail in FIG. 2), with these line slots 114 being configured to removably engage the elongated lines 300 and/or 400 discussed below.

(2) Flexible elongated straps 200, which may be formed of nylon webbing or the like, which are each configured for removable installation into one of the bar strap slots 108. The straps 200 have widths which are at least substantially the same as the length of each bar strap slot 108, and can be inserted into the bar strap slots 108 as illustrated by the left strap 200 in FIG. 1, e.g., the right strap 200 of FIG. 1 may be inserted into its adjacent bar strap slot 108 so that it rests therein to resemble the left strap 200 within its bar strap slot 108. Additionally, when each bar end cap 106 is attached to its bar end 106 with the strap 200 resting within the bar strap slot 108 (as illustrated at the left side of the bar 100 in FIG. 1), the strap 200 extends through both the bar strap slot 108 and the cap strap slot 112, and the bar end cap 106 deters withdrawal of the strap 200 from the bar strap slot 108 along a direction oriented along the length of the bar 100. The straps 200 each bear a strap stop 202 situated along the strap 200, wherein the strap stop 202 is configured to deter withdrawal of the strap 200 from the bar strap slot 108 in a direction oriented along the length of the strap 200 when the strap 200 rests within the bar strap slot 108. The straps 200 also each preferably bear an anchoring means 204, spaced from the strap stop 202 along the length of the strap 200 at the (actual or effective) strap end 206, for engaging the strap 200 to an object. The straps 200 can therefore be used with the bar 100 to perform suspended bodyweight exercise or other exercises, as discussed below.

(3) Flexible elongated lines 300 and/or 400, each of which has an enlarged line end 302/402. Each elongated line 300/400 is configured such that the enlarged line end 302/402 cannot pass through the line slot 114, but the adjacent portion of the elongated line 300/400 can freely pass through the line slot 114. Thus, as illustrated in FIGS. 3A-3D, if the elongated line 300 of FIG. 1 is inserted through the larger portion of the line slot 114 shown in FIG. 2 until its enlarged line end 302 clears the line slot 114, and the elongated line 300 is then translated leftwardly in FIG. 2 to the smaller portion of the line slot 114 with an attempt thereafter being made to withdraw the elongated line 300 from the line slot 114, the enlarged line end 302 will resist withdrawal from the line slot 114 because its size does not permit withdrawal from the smaller portion of the line slot 114. The exemplary elongated lines 300/400 of FIG. 1 include an elastic elongated line 300, which may be formed of elastomeric tubing with a plug (not shown) inserted therein to generate the enlarged line end 302, and an inelastic elongated line 400 formed of an inelastic strap 404 affixed to a ring 406, with a bolt 408 extending from the ring 406 and having an elastomeric plug 402 thereon to serve as its enlarged line end. Elastic lines 300 can be used with the bar 100 to perform elastic resistance exercises, and inelastic lines 400 can be used with the bar 100 to perform suspended bodyweight exercises, as discussed below.

(4) Bar supports 500, each of which includes bar engagement means for removably engaging the bar 100, and a bar support leg 502 extending from the bar engagement means, whereby the bar support 500 can be engaged to the bar 100 with its support leg 502 supporting the bar 100 above a floor. A user can therefore install a pair of bar supports 500 along the bar 100 (with one of the bar supports 500 being shown installed in FIG. 1, and its twin bar support 500 being shown removed), and support the bar 100 above the floor with the bar supports 500 so that the user might comfortably perform push-ups while grasping the bar 100. The bar engagement means of the bar supports 500 include a sleeve 504 configured to fit about the outer circumference of the bar 100 (which is preferably formed with an oval or other non-circular circumference to prevent rotation of the sleeve 504 about the bar 100), and a bar support leg 502 defined by a closed loop having a handle 506 thereon, whereby the bar support leg 502 defines a grip (the use of which will be discussed at greater length below). Exemplary alternative bar supports 600, which have bar support legs 602 which are not configured as grips, have bar engagement means including a sleeve 604 configured to fit partially about the outer circumference of the bar 100, and a tongue-like male member 608 configured to be removably fit within the bar strap slot 108.

(5) Grips 700 configured for engagement by a user's hand and/or foot, wherein these grips 700 are separate from the bar 100 (i.e., they are separate from the grip(s) defined by the circumference of the bar 100). Preferably, these grips 700 are defined by closed loops bearing a handle 706, as with the grip defined by the bar support 500. The grips 700 bear line slots 714 similar to those on the bar end caps 110, whereby the enlarged line ends 302/402 of the elongated lines 300/400 can be removably engaged within the line slots 714. (The line slots 714 of the grips 700 are depicted with "impingers" 710, i.e., structures movable into the line slots 114 to inhibit displacement of any elongated lines 300/400 therein; these impingers 710 will be discussed at greater length below.) The grips 500 also include line slots 514 opposite their handles 506, allowing their use either on or off of the bar 100 with the elongated lines 300 or 400 affixed to the grips 500.

All or some of the foregoing components can be provided in combination to provide a user with a portable and lightweight exercise system which is capable of being used for many different exercises. As a first example, the bar 100 may have the straps 200 installed therein, and the straps 200 may be engaged to an overhead beam or other object, so that a user may perform suspended bodyweight exercise. To illustrate, the user may suspend the bar 100 in trapeze-like fashion at waist height, situate himself or herself under the bar 100 with his/her arms reaching upwardly to grasp the bar 100 from beneath, and may hold his/her body inclined with heels on the floor, and may then perform inclined pull-ups. Inelastic elongated lines 400 installed within the line slots 114 in the bar end caps 110 can also or alternatively be used for this purpose. Rather than using the bar 100 for suspended bodyweight exercise, the grips 500 and/or 700 can be used with the inelastic elongated lines 400 mounted within their bar slots 514/714 for this purpose (again with the lines 400 being anchored to at their ends 402 to some nearby structure). Alternatively, elastic resistance exercises can be performed with a single elastic line 300 installed on the bar 100 between the line slots 114 (or between the line slots 514 on the installed grips 500); with separate elastic lines 300 installed in the line slots 114 and extending to grips 500 or 700 spaced from the bar 100, or to some anchoring structure; or with a single elastic line 300 installed between a pair of grips 500 and/or 700 situated off the bar 100. As previously noted, the bar 100 may bear bar supports 500/600 to ease the performance of pushups on the bar 100 (and if desired, the user may increase the operative resistance when performing pushups by extending an elastic line 300 between the line slots 114 or 514 to rest across the user's back).

Other arrangements and exercises are possible as well, and the reader is directed to the patents and other documents referred to in this document for examples. Further advantages, features, and objects of the invention will be apparent from the remainder of this document in conjunction with the associated drawings.

DETAILED DESCRIPTION OF PREFERRED VERSIONS OF THE INVENTION

Figure 1:
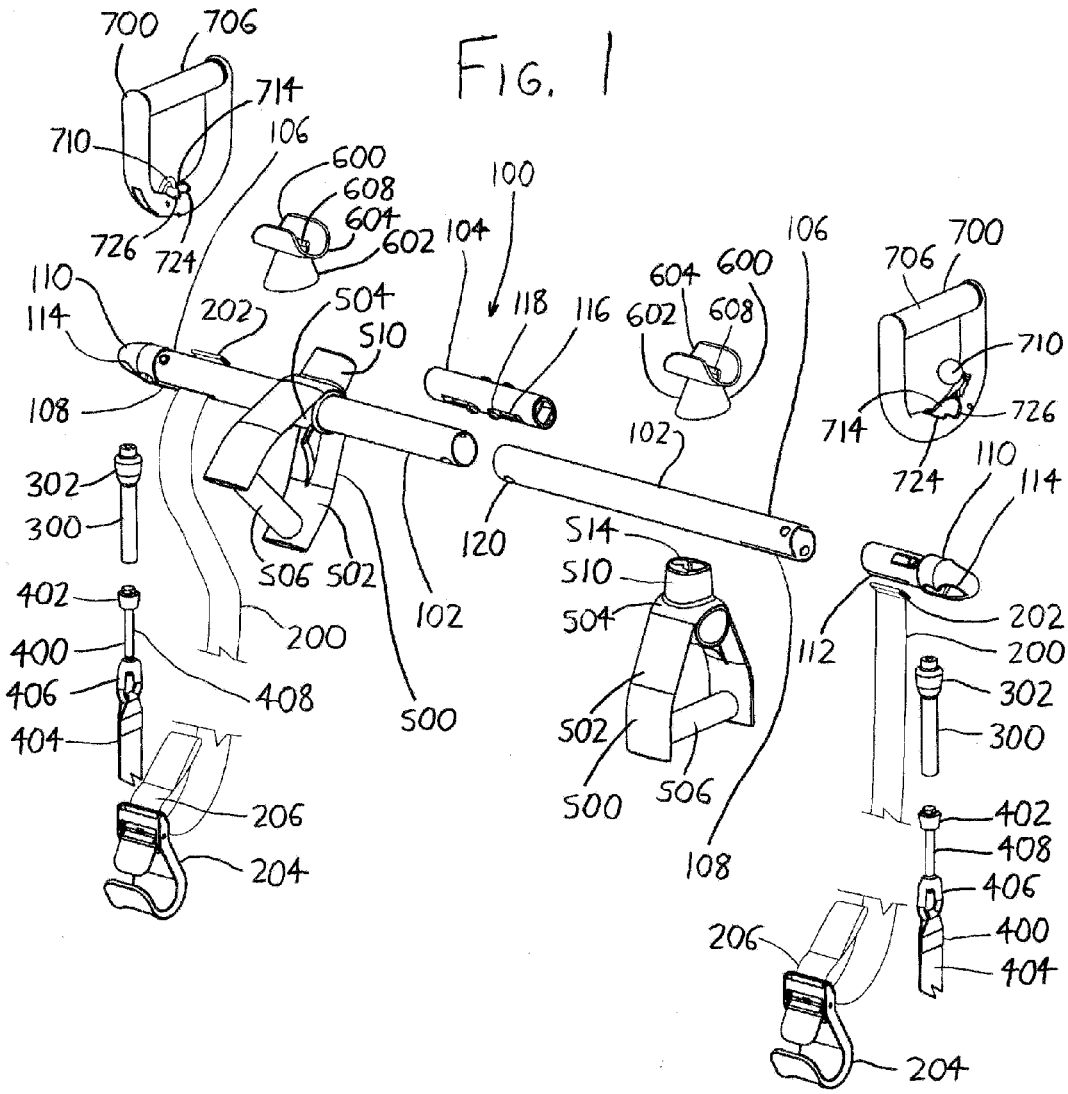
FIG. 1 is a partially disassembled view of an exercise bar 100, shown with straps 200 (and lines 400) engageable to the bar 100 for use in suspended bodyweight exercises, and lines 300 engageable to the bar 100 for use in elastic resistance exercises, as well as a set of handles 700 which can be engaged to the bar 100 (or with each other) via the lines 300 and/or 400, and a bar support 500 which can be used to support the bar 100 off the floor for use in performing push-ups (and which can also be used as handles in a matter similar to handles 700).

Expanding on the discussion above, the various components need not be provided in the exemplary forms depicted in the accompanying drawings, and they may have alternative or additional structures, appearances, and functions. Following is a review of the various components discussed above, and some of their exemplary possible features.

The bar 100 is preferably formed of metal or other tubing, e.g., pultruded fiber/resin or other composite tubing, and is formed in at least two bar sections 102 joinable by a bar section connector 104, thereby allowing easy disassembly and storage of the bar 100. Here the bar section connector 104 is provided as a plastic plug which closely fits in the adjoining ends of the bar sections 102, and which bears leaf springs 116 formed therein which terminate in protruding buttons 118. When the bar section connector 104 is inserted into an end of one of the bar sections 102, its corresponding leaf spring 116 (and button 118) may be inwardly flexed, with the button 118 then popping outwardly into an engagement aperture 120 formed at the end of the bar section 102 to engage the bar section connector 104 to the bar section 102. For disassembly of the bar 100, each button 118 may be depressed within its engagement aperture 118 to allow withdrawal of the bar section connector 104 from the bar section 102. Other arrangements are possible, e.g., the bar 100 may be formed as a single unitary length rather than in two or more sections. Where separable bar sections 102 are provided, they may use other engagement arrangements, such as complementarily interfitting ends (e.g., threaded male/female ends).

At the bar ends 106, the bar end caps 110 are similarly formed to closely fit within the interior of the bar 100, and to releasably engage the bar ends 106 via a leaf spring, button, and engagement aperture arrangement similar to the ones used to join the bar sections 102 and bar section connector 104. Here too other arrangements are possible, e.g., the bar end caps 110 can fit over or otherwise engage with the bar ends 106 using different attachment arrangements. It is also possible that bar end caps 110 need not be provided, or their functionality may be provided on the bar ends 106 themselves, e.g., the bar ends 106 might bear the line slots 114 therein, with the bar strap slots 108 extending through the bar ends 106 perpendicularly to the line slots 114. Since the bar end caps 110 assist in holding the straps 200 fixed to the bar ends 106 (if the straps 200 are used with the bar 100), if the bar end caps 110 are omitted, some alternative form of barrier means for selectively deterring withdrawal of the strap 200 from the bar strap slot 108 may be useful, such as a latch, strap, or other member which folds and affixes about the bar ends 106 to obstruct the bar strap slot 108. As another alternative, a pin, bar 100, or other member on each bar end 106 could be translated, rotated, or otherwise inserted into the bar strap slot 108 (or adjacent to its mouth) to block passage of the strap 200 out of the bar strap slot 108. A barrier means for deterring the exit of the strap 200 from the bar strap slot 108 might also be simply provided by some form of obstruction formed in the bar strap slot 108 near its mouth. For example, if the bar strap slot 108 adopts a nonlinear path near its mouth—such as a pair of right-angle bends—the strap 200 might be folded or otherwise manipulated along its width so that it can be slid into the bar strap slot 108. However, these bends may then resist withdrawal of the strap 200 (particularly when the strap 200 is pulled taut) unless the strap 200 is similarly manipulated for removal.

It is also not necessary that the remainder of the bar strap slot 108—i.e., the portion of its length in which the strap 200 rests when in use—be linear. For example, if the bar strap slot 108 is defined along a zig-zag path, the strap 200 can be folded/manipulated by a user to rest within the bar strap slot 108, but the strap 200 will thereafter resist withdrawal from the bar strap slot 108 unless manipulated by a user (particularly when the strap 200 is pulled taut).

The bar strap slot 108 also need not be situated directly at a terminal end of the bar 100, and may be spaced from a terminal end of the bar 100. As an example, the bar strap slot 108 might be defined within the bar 100—e.g., along a plane situated halfway between top and bottom surfaces of the bar 100—a short distance from the terminal end of the bar 100. Another slot, an "insertion slot," might then extend into the top of the bar 100 such that the insertion slot intersects the bar strap slot 108 at a location spaced slightly from a first end of the bar strap slot 108, such that the insertion slot forks off of the bar strap slot 108 near its first end. (As an example, imagine the bar strap slot 108 extending through the bar 100 along a plane intersecting its lengthwise axis and forming the straight major leg of a "y," with the insertion slot extending from the top of the bar 100 and defining the intersecting minor leg.) With this arrangement, a strap 200 can be slid into the insertion slot until it enters the bar strap slot 108, can then be slid along the bar strap slot 108 until it abuts the second end of the bar strap slot 108 (at which point the strap 200 has preferably exited the insertion slot such that it rests solely within the bar strap slot 108), and may then be slid along the bar strap slot 108 until it abuts the first end of the bar strap slot 108. Once the strap 200 is slid from the insertion slot into the bar strap slot 108, it resists exiting the bar strap slot 108 unless a user bends one of the sides of the strap 200 to enter the insertion slot.

While each bar strap slot 108 is preferably provided as illustrated in FIG. 1, with each bar strap slot 108 opening on locations circumferentially spaced around the bar 100, each bar strap slot 108 could instead merely extend partway through the bar 100, with a cavity being defined within the bar 100 to receive the strap stop 202. As a simple example, a strap 200 in FIG. 1 could be inserted within a bar strap slot 108 in a direction oriented axially along the length of the bar 100, with the strap stop 202 being received within the interior of the tubular bar 100 rather than at the opposite side of the bar 100. The strap stop 202 is not withdrawable from the wall of the tubular bar 100 in a direction oriented along the length of the strap 200, owing to the sizing of the strap stop 202 being greater than the sizing of the bar strap slot 108.

The line slots 114, 514, and 714 provide a particularly beneficial arrangement for rapid attachment and detachment of lines 300 and/or 400 to grips (e.g., to the bar 100 or to the handles 506 and 706), and/or to other structures. While the line slots 114 could simply take the form of the slot-like line attachment arrangements shown in (for example) U.S. Pat. No. 5,131,650 to Hall, U.S. Pat. No. 6,988,978 to Nault et al., and/or U.S. Pat. No. 7,578,775 to Terry, they preferably take the form of the illustrated line attachment aperture 114 shown in greater detail in FIGS. 2 and 3 for the bar end caps 110. The line attachment aperture 114 defines a passage through the bar end cap 106 (or the grips 500 and 700) having a closed (i.e., continuous) line attachment aperture inner circumference 122 surrounding an insertion aperture portion 124, a retention aperture portion 126, and a throat 128 situated between the insertion and retention aperture portions 126 and 128. These are configured such that an elongated line 300/400 can freely pass through the insertion aperture portion 124, the retention aperture portion 126, and the throat 128 therebetween. However, while an enlarged line end 302/402 on the elongated line 300/400 can pass through the insertion aperture portion 124, it cannot also pass through the retention aperture portion 126. As a result, an enlarged line end 302/402 can be inserted through the insertion aperture portion 124 (FIGS. 3A-3B), the elongated line 300/400 can then be moved from the insertion aperture portion 124 to the retention aperture portion 126 (FIG. 3C), with the elongated line 300/

Figure 3A:
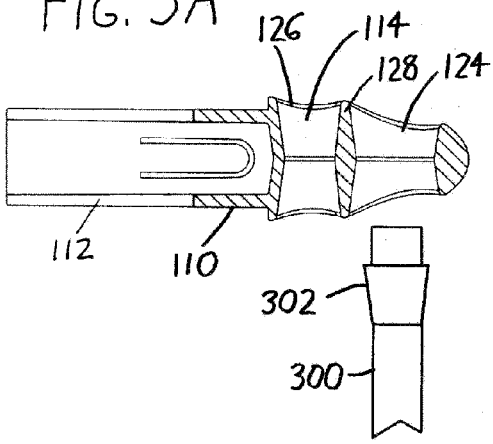
FIGS. 3A-3D present schematic side cross-sectional views illustrating the installation of one of the lines 300 within one of the bar end caps 110 of the bar 100 of FIG. 1.
Figure 3B:
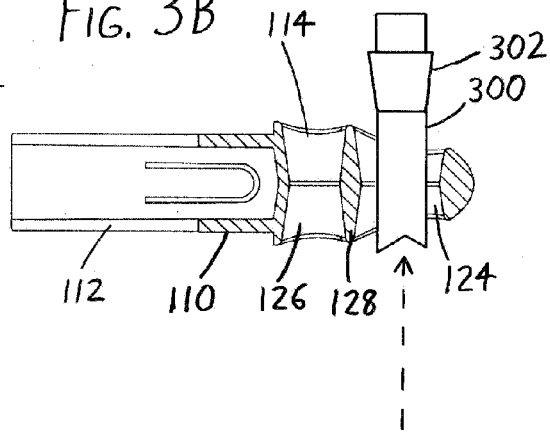
Figure 3C:
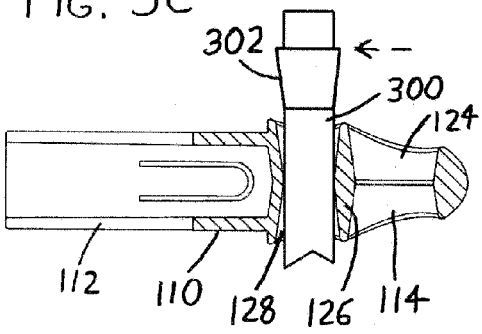
Figure 3D:
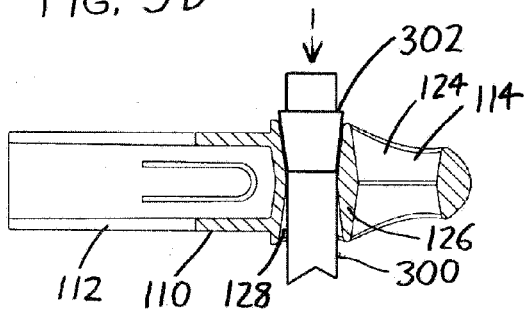

400 thereafter being prevented from withdrawal from the retention aperture portion 126 owing to interference between the enlarged line end 302/402 and a portion of the bar end cap 106 situated about the retention aperture portion 126 (FIG. 3D). The closed circumference 122 of the line attachment aperture 114, as opposed to the open-slotted configurations shown in the aforementioned patents, better retains an elongated line 300/400 situated within the line attachment aperture 114 against unwanted dislodgement. Additionally, the closed circumference 122 can provide superior strength and better resistance against breakage, and it better avoids the catching of the bar ends 106 (or more particularly, their bar end caps 110) on clothing or other matter.

To review the structure of the line attachment aperture 114 in greater detail, the insertion aperture portion 124 must be sized and shaped such that an enlarged line end 302/402 can be fit therein, and the width/diameter of the retention aperture portion 126 (as measured perpendicular to a plane extending across the major diameter of the line attachment aperture 114, and bisecting the throat 128) is lesser, such that it will prevent withdrawal of the enlarged line end 302/402. The throat 128 is preferably defined by a reduction in the width/diameter of the insertion aperture portion 124. However, the width/diameter of the throat 128 need not necessarily be smaller than that of the retention aperture portion 126—e.g., the throat 128 and retention aperture portion 126 can simply define a slot extending from the insertion aperture portion 124—though a converging throat 128 is useful to deter the line 300/400 from slipping out of the retention aperture portion 126. This is particularly so where the line 300/400 is formed of tubing or other material which can be pinched, urged through the throat 128 into the retention aperture portion 126, and then released to expand. The retention aperture portion 126 preferably maintains at least the same width as the throat 128 as it extends therefrom for a distance of at least half of the width of the throat 128 (i.e., if the retention aperture portion 126 narrows, it preferably does so after leaving enough space to accommodate the line 300/400).

Figure 2:
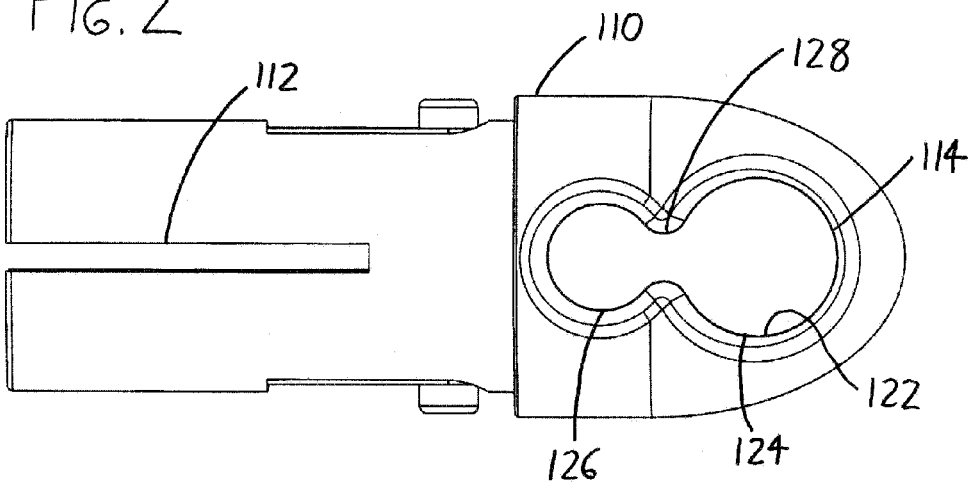
FIG. 2 is a top plan view of one of the bar end caps 110 of the bar 100 of FIG. 1.

While the insertion and retention aperture portions 126 and 128 need not be circular (or otherwise shaped complementary to the cross-sections of the elongated line 300/400 and its enlarged line end 302/402), they preferably define a lemniscate ("FIG. 8") shape as shown in FIG. 2, wherein the throat 128 reduces in size as the line attachment aperture 114 transitions from the insertion aperture portion 124 to the retention aperture portion 126, and also as the line attachment aperture 114 transitions from the retention aperture portion 126 to the insertion aperture portion 124. Other "multi-lobed" shapes are possible (e.g., trefoil or "cloverleaf" shapes wherein one of the lobes is an insertion aperture portion 124 and the adjoining lobes are retention aperture portions 126, or shapes wherein a central insertion aperture portion 124 has multiple retention aperture portions 126 on opposite/different sides, etc.).

Additionally, it is preferred that at least the retention aperture portion 126 converges/narrows as it extends between the opposing sides of the line attachment aperture 114 (as seen in FIGS. 3A-3B), such that an enlarged line end 302/402 wedges into the retention aperture portion 126 when it is pulled through (as seen in FIGS. 3C-3D). Preferably, the retention aperture portion 126 has its narrowest diameter at a location approximately halfway between the opposing sides of the line attachment aperture 114. In contrast, the insertion aperture portion 124 preferably maintains an at least substantially constant average diameter as it extends between the opposing sides of the line attachment aperture 114, as this eases passage of the insertion aperture portion 124 through the insertion aperture portion 124.

While it is preferred that the insertion aperture portion 124, retention aperture portion 126, and throat 128 have parallel axes, this is not essential, and the axis or axes of one or more of these passages may be angled with respect to the axis or axes of one or more of the other passages. For example, consider the bar end cap 106 of FIG. 2 wherein the retention aperture portion 126 is oriented as depicted—along an axis oriented generally perpendicular to planes defining the top and bottom of the bar 100—but wherein the insertion aperture portion 124 is oriented such that its axis is rotated about the length of the bar 100, whereby its axis is not parallel to the axis of the retention aperture portion 126. Such an arrangement can further assist with retention of a line 300/400 within the bar 100.

Additionally, the axes of the insertion aperture portion 124, retention aperture portion 126, and throat 128 need not be linear. For example, the throat 128 may extend along an angled or curved path, as with the "cord insertion slots" shown in FIGS. 2-3 and 6-9 of both U.S. Pat. No. 6,497,671 to Hinds, and U.S. Pat. No. 6,923,750 to Hinds.

While the line attachment apertures 114 and 714 formed in the bar 100 (the bar end caps 110) and in the grip 700 have exposed opposing openings, the line attachment apertures 514 formed in the grips 500 are defined in "plateaus" 510 provided atop the sleeves 504 and opposite the bar support legs 502 (and handles 506). This allows elongated lines 300 and/or 400 to be affixed within the line attachment apertures 514 while the grips 500 are affixed to the bar 100. However, if desired, the line attachment apertures 514 could alternatively (or additionally) be defined directly in the walls of the sleeves 504. In similar respects, line attachment apertures 114/514/714 could be provided elsewhere on other components. As an example, where the bar 100 is formed of tubing (as it is in FIG. 1), line attachment apertures 114 might be formed about the circumference of the bar 100 (in a tube wall, without extending from one side of the bar 100 to its opposing side) at locations spaced from the bar ends 106.

As with the line attachment apertures 714 formed in the grips 700, the line attachment apertures 114/514 might each include impingers 710, i.e., structures that are movable at least partially into a portion of the line attachment aperture to hinder withdrawal of the enlarged line end 302/402, and/or to bear against the line 300/400 at a location spaced from the line end 302/402 to engage the line 300/400 at a location spaced from the line end 302/402. Examples of impingers can be found, for example, in U.S. Pat. No. 6,663,544 to Hinds, U.S. Pat. No. 7,147,592 to Hinds, and U.S. Pat. No. 7,316,636 to Hinds. The grips 700 of FIG. 1 utilize impingers 710 resembling those in U.S. Pat. No. 7,316,636 to Hinds, wherein each impinger 710 is hingedly affixed to the grip 700 such that it can swing into the retention aperture portion 726 to bear against the line 300/400 as described in that patent. Each impinger 710 could instead be configured such that it moves into and obstructs the insertion aperture portion 724, such that the line 300/400 cannot be moved into the insertion aperture portion 724 and withdrawn from the grip 700 until the impinger 710 is removed from the insertion aperture portion 724 of the line attachment aperture 714.

The straps 200 are preferably formed of flat material which is flexible but at least substantially inelastic, such as nylon webbing, though elastic straps might be substituted if the straps 200 are to be used for elastic resistance exercises rather than for suspended bodyweight exercise. The straps 200 preferably each have a width which is at least substantially the same as the lengths of the bar strap slots 108 when the bar strap slots 108 are obstructed by the bar end caps 110 (or by other barrier means), such that the straps 200 do not shift about overmuch within the bar strap slots 108 when installed therein for use. (When it is said that the strap width is at least substantially the same as the length of the bar strap slot 108, this should be regarded as meaning that the width of the strap 200 is the same as the length of the bar strap slot 108, or is within 50% of the length of the bar strap slot 108, i.e., that the strap width is between 50%-150% of the length of the bar strap slot 108.) The strap stops 202 may be formed by folding over or rolling a portion of the length of the strap 200 and then sewing or otherwise affixing this portion, or by sewing or otherwise affixing a bar, rod, or other obstruction within a folded or rolled portion of the length of the strap 200.

The descending strap ends 206 are illustrated with anchoring means 204 allowing anchoring of the strap 200 to an object in its environment, with the anchoring means 204 being provided in the form of hook-bearing cambuckles, i.e., structures similar to those shown in U.S. Pat. No. 4,567,628 to Prete, Jr. et al., wherein a cambuckle or other strap-engaging mechanism bears a hook (preferably a carabiner-like hook as depicted), whereby the hook can be repositioned along the strap 200 as desired by a user. Such hooked cambuckles 204 are useful for affixing the straps 200 to poles or the like. However, different or additional anchoring means for engaging the straps 200 to poles, tree limbs, wall-mounted or ceiling-mounted eyelets, doorways, or other structures could be provided. For example, the strap ends 206 can simply be knotted so that when the straps 200 are closed in a door, the knots define anchoring means which prevent the straps 200 from sliding out from between the door and its doorframe. Exemplary preferred anchoring means are illustrated in International (PCT) Patent Appln. Publ'n. WO/2012027371, which describes "buttons" situated on the straps 200 (wherein the buttons can function similarly to the aforementioned knots), and loops situated on the straps 200 and on separate members into which the buttons may be fit. Anchoring means 204 could instead or additionally be provided in the form of hooks, carabiners or other openable and closable fasteners, or simply as a strap end 206 or other member(s) suitable for doubling/wrapping about a structure and then being tied or otherwise affixed to the remaining length of the strap 200 such that the strap 200 is affixed to the structure.

The lines 300 and/or 400 can be formed of elastic or inelastic straps, cords/cables, beams, chains, or other structures. The enlarged line ends 302/402 can be defined by members wound about (or otherwise affixed or formed on) the lines 300 and/or 400 to increase their effective diameters, or by members inserted or formed within or along the lines 300/400 to increase their effective diameters, e.g., as a simple knot formed along a line 300/400.

The elastic line 300 of FIG. 1 has a form similar to the line of FIGS. 4 and 16A-16B of U.S. Pat. No. 7,578,775 to Terry, which shows an elongated line formed as an elastic tube, with plugs inserted into the tube's ends to define enlarged line ends. While the unshown opposite end of the line 300 is preferably formed with an enlarged line end 302 similar to the one shown, thereby allowing the enlarged line ends 302 to be interchangeably received within line attachment apertures 114, 514, and/or 714, it could instead be provided with a hook, carabiner, or other anchoring means, or with a permanently-affixed grip, or with other structures as discussed for the straps 200 above.

The inelastic line 400 of FIG. 1 need not necessarily be provided in the form of a strap 404, and it could instead be provided as some other inelastic structure such as cords/cables, beams, chains, or other structures. As with the elastic line 300 discussed above, the unshown opposite end of the inelastic line 400 is preferably formed with an enlarged line end 402 similar to the one shown, thereby allowing the enlarged line ends 402 to be interchangeably received within line attachment apertures 114, 514, and/or 714. However, here too the unshown end of the line 400 could instead be provided with a hook, carabiner, or other anchoring means, or with a permanently-affixed grip, or with other structures as discussed for the straps 200 above.

The lines 300/400 need not be used with the bar 100, and could be used solely in combination with grips such as grips 500 and 700. As a first example, an elastic line 300 can have grips 500 or 700 (or other grips) attached to its ends, with a user then engaging the grips with his/her hands and/or feet to perform exercises without use of the bar 100. As another example, an inelastic line 400 can have grips 500 or 700 (or other grips) attached to its ends so that the line 400 and the grips defines a suspended bodyweight exercise device similar to those described in the aforementioned patents related to suspended bodyweight exercise (in particular, similar to the devices described in U.S. Pat. No. 6,921,354 to Shifferaw and U.S. Pat. No. 7,651,448 to Hetrick).

The bar supports 500/600 (if provided) preferably have bar engagement means formed as a sleeve 504/604 configured to complementarily receive at least a portion of the circumference of the bar 100 therein, but the bar supports 500/600 may alternatively or additionally have other forms of bar engagement means, e.g., male members or female apertures which complementarily engage mating structures on the bar 100. The bar supports 600 include both types of structures, with a bar engagement means defined by a sleeve 604 fitting about a portion of the outer circumference of the bar 100, and a tongue-like male member 608 which can be removably inserted within the bar strap slot 108. The bar support leg can merely have a structure dedicated to supporting the bar engagement means (and thus the bar 100) above a floor, as with the bar support leg 602, or it can be structured to have other functions as well, e.g., as a grip as in the bar support leg 502. A grip bearing bar engagement means, as with the bar support/grip 500, can beneficially be used as a grip when it is engaged with the bar 100, such that a user can grasp the bar 100 via the grips 500. Another possible structure for a bar support is as a wheel or roller, whereby the bar 100 can travel along the floor via the rolling wheel(s)/roller(s) for use as described in U.S. Pat. No. 6,053,853 to Hinds and U.S. Pat. No. 6,575,883 to Hinds.

Grips can assume a variety of forms, e.g., as a portion of the length of the exercise bar 100 (as with the grips defined by the bar sections 102), as grips separate from the exercise bar 100 (as with the grips 500/700), or otherwise, and may include loop-type grips as with the grips 500/700 (wherein the loops need not be rigid, as in U.S. Pat. No. 6,497,671 to Hinds and U.S. Pat. No. 6,923,750 to Hinds), or as "baton" or other non-loop-type grips (as seen in, for example, U.S. Pat. No. 3,256,015 to Perrin et al., U.S. Pat. No. 4,059,265 to Wieder et al., U.S. Pat. No. 4,328,964 to Walls, U.S. Pat. No. 5,746,687 to Vial et al., and U.S. Pat. No. 6,648,804 to Chen), or as other forms of grips. As examples, grips can be formed with configurations resembling those in U.S. Pat. No. 5,131,650 to Hall, U.S. Pat. No. 6,402,668 to Harker, U.S. Pat. No. 6,692,415 to Winston, U.S. Pat. No. 7,578,775 to Terry, U.S. Patent Appln. Publ'n. 20090253557 to Klein, and/or in other references. Grips as in International (PCT) Patent Appln. Publ'n. WO/2012027371, which can readily engage hands or feet, are particularly advantageous.

The invention may also incorporate features of any of the patents and patent applications noted earlier in this document. The technical contents of these documents are incorporated by reference within this document, such that the features described therein should be regarded as a portion of this document.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. An elongated exercise bar including:

a. a bar end having
(1) an elongated bar strap slot, and
(2) a line slot,
defined therein;

b. an elongated strap the strap being at least substantially inelastic and having:
(1) a width at least substantially the same as the length of the bar strap slot,
(2) a strap stop situated along the strap, the strap stop being configured to deter withdrawal of the strap from the bar strap slot in a direction oriented along the length of the strap when the strap rests within the bar strap slot;
(3) anchoring means for engaging the strap to an object, the anchoring means being spaced from the strap stop along the length of the strap;

c. an elongated line, the line being at least substantially elastic and having an enlarged line end, wherein:
(1) the line is configured to freely pass through the line slot,
(2) the enlarged line end is sized such that it cannot pass through the line slot, whereby the line can be removably engaged within the line slot.

2. The exercise bar of claim 1 wherein the bar strap slot opens on locations circumferentially spaced around the bar end.

3. The exercise bar of claim 1 further including a bar end cap removably attachable to the bar end, the bar end cap including a cap strap slot defined therein, wherein when the bar end cap is attached to the bar end with the strap resting within the bar strap slot:

a. the strap extends through both the bar strap slot and the cap strap slot, and b. the bar end cap deters withdrawal of the strap from the bar strap slot along a direction oriented along the length of the bar.

4. The exercise bar of claim 1 further including:

a. a bar end cap removably attachable to the bar end, the bar end cap including the line slot defined therein, wherein when the bar end cap is attached to the bar end, the entirety of the line slot is spaced from the bar end.

5. The exercise bar of claim 4 wherein the elongated line bears a grip, the grip being defined by a closed loop bearing a handle configured for engagement by a user's hand and/or foot.

6. The exercise bar of claim 4 wherein the line slot is defined by a line attachment aperture:

a. having:
(1) an insertion aperture portion,
(2) a retention aperture portion, and
(3) a throat situated between the insertion and retention aperture portions, surrounded by a closed line attachment aperture inner circumference;

b. configured such that:
(1) the elongated line can freely pass through the insertion aperture portion, the retention aperture portion, and the throat therebetween, and
(2) the enlarged line end can pass through the insertion aperture portion, but cannot also pass through the retention aperture portion.

7. The exercise bar of claim 1 further including a bar end cap removably attachable to the bar end, wherein the bar end cap:

a. when attached to the bar end with the strap resting within the bar strap slot, deters withdrawal of the strap from the bar strap slot along a direction oriented along the length of the bar;

b. includes a line attachment aperture:
(1) extending through the bar end cap from a first side to a second side,
(2) having:
(a) an insertion aperture portion,
(b) a retention aperture portion,
(c) a throat situated between the insertion and retention aperture portions,
(3) configured such that:
(a) an elongated line can freely pass through the insertion aperture portion, the retention aperture portion, and the throat therebetween, and
(b) an enlarged line end on the elongated line can pass through the insertion aperture portion, but cannot also pass through the retention aperture portion, whereby:

i. the enlarged line end of such an elongated line can be inserted through the insertion aperture portion, ii. the elongated line can then be moved from the insertion aperture portion to the retention aperture portion, with the elongated line thereafter being prevented from withdrawal from the retention aperture portion owing to interference between the enlarged line end and a portion of the bar end cap situated about the retention aperture portion.

8. The exercise bar of claim 1 further including a bar support including:

a. bar engagement means for removably engaging the bar, and b. a bar support leg extending from the bar engagement means, wherein the bar support is configured to engage the bar with its bar support leg supporting the bar above a floor.

9. The exercise bar of claim 8 wherein the bar engagement means includes a male member configured to fit within the bar strap slot.

10. The exercise bar of claim 8 wherein the bar engagement means includes a sleeve configured to fit at least partially about the outer circumference of the bar.

11. The exercise bar of claim 8 wherein the bar support leg is defined by a closed loop having a handle thereon, whereby the bar support leg defines a grip.

12. The exercise bar of claim 8 wherein the bar support bears a line attachment aperture:

a. having:
(1) an insertion aperture portion,
(2) a retention aperture portion, and
(3) a narrowed throat situated between the insertion and retention aperture portions,
surrounded by a closed line attachment aperture inner circumference;

b. configured such that:
(1) the elongated line can freely pass through the insertion aperture portion, the retention aperture portion, and the throat therebetween, and
(2) the enlarged line end can pass through the insertion aperture portion, but cannot also pass through the retention aperture portion.

13. The exercise bar of claim 1 further including:
a. an elongated line having an enlarged line end;
b. a line attachment aperture:
(1) situated along the bar;
(2) having:
(a) an insertion aperture portion,
(b) a retention aperture portion, and
(c) a throat situated between the insertion and retention aperture portions,
(d) a closed line attachment aperture inner circumference surrounding the insertion aperture portion, retention aperture portion, and throat;
(3) being configured such that:
(a) the elongated line can freely pass through the insertion aperture portion, the retention aperture portion, and the throat therebetween, and
(b) the enlarged line end can pass through the insertion aperture portion, but cannot also pass through the retention aperture portion.

14. The exercise bar of claim 13 further including a grip, the grip being defined by a closed loop bearing:
a. a handle configured for engagement by a user's hand and/or foot;
b. a line attachment aperture:
(1) spaced from the handle;
(2) having:
(a) an insertion aperture portion,
(b) a retention aperture portion, and
(c) a throat situated between the insertion and retention aperture portions,
(d) a closed line attachment aperture inner circumference surrounding the insertion aperture portion, retention aperture portion, and throat;
(3) being configured such that:
(a) the elongated line can freely pass through the insertion aperture portion, the retention aperture portion, and the throat therebetween, and
(b) the enlarged line end can pass through the insertion aperture portion, but cannot also pass through the retention aperture portion.

15. An elongated exercise bar including:
a. an elongated bar strap slot defined therein, the bar strap slot being configured to accommodate a portion of a length of an elongated strap therein;
b. a line slot defined therein, the line slot being:
(1) spaced from the bar strap slot, and
(2) configured to releaseably engage an elongated line having an enlarged line end by:
(a) having the elongated line insert within the line slot, and
(b) preventing withdrawal of the enlarged line end through the line slot;
c. at least one of:
(1) an elongated strap configured for removable installation in the bar strap slot, the elongated strap being at least substantially inelastic and having:
(a) a width at least substantially the same as the length of the bar strap slot,
(b) a strap stop situated along the strap, the strap stop being configured to deter withdrawal of the strap from the bar strap slot in a direction oriented along the length of the strap when the strap rests within the bar strap slot; and
(2) an elongated line having an enlarged line end, the elongated line being at least substantially elastic and configured for removable installation in the line slot.

16. An elongated exercise bar including:
a. an at least substantially elastic elongated line having an enlarged line end;
b. a line attachment aperture:
(1) situated along the bar;
(2) having:
(a) an insertion aperture portion,
(b) a retention aperture portion, and
(c) a throat situated between the insertion and retention aperture portions,
(d) a closed line attachment aperture inner circumference surrounding the insertion aperture portion, retention aperture portion, and throat;
(3) being configured such that:
(a) the elongated line can freely pass through the insertion aperture portion, the retention aperture portion, and the throat therebetween, and
(b) the enlarged line end can pass through the insertion aperture portion, but cannot also pass through the retention aperture portion;
c. an elongated bar strap slot situated along the bar spaced from the line attachment aperture; and
d. an at least substantially inelastic elongated strap having anchoring means thereon for engaging the strap to an object.

17. The exercise bar of claim 16 wherein the elongated line bears a grip spaced from its enlarged line end, the grip being defined by a closed loop bearing a handle configured for engagement by a user's hand and/or foot.

18. The exercise bar of claim 17 wherein the grip includes a line attachment aperture:
a. situated thereon spaced from the handle;
b. having:
(1) an insertion aperture portion,
(2) a retention aperture portion, and
(3) a throat situated between the insertion and retention aperture portions,
(4) a closed line attachment aperture inner circumference surrounding the insertion aperture portion, retention aperture portion, and throat;
c. being configured such that:
(1) the elongated line can freely pass through the insertion aperture portion, the retention aperture portion, and the throat therebetween, and
(2) the enlarged line end can pass through the insertion aperture portion, but cannot also pass through the retention aperture portion.

19. The exercise bar of claim 16 wherein the strap further has:
a. a width at least substantially the same as the length of the bar strap slot,
b. a strap stop situated along the strap, the strap stop being configured to deter withdrawal of the strap from the bar strap slot along a direction oriented along the length of the strap when the strap rests within the bar strap slot.

20. The exercise bar of claim 16 further including a bar end cap removably attachable to the bar end, wherein the bar end cap includes the line attachment aperture thereon.

21. The exercise bar of claim 20 wherein the bar end cap includes a cap strap slot defined therein, wherein when the bar end cap is attached to the bar end with the strap resting within the bar strap slot:

a. the strap extends through both the bar strap slot and the cap strap slot, and b. the bar end cap deters withdrawal of the strap from the bar strap slot along a direction oriented along the length of the bar.

22. The exercise bar of claim 16 further including a bar support including:

a. bar engagement means for removably engaging the bar, and b. a bar support leg extending from the bar engagement means, wherein the bar support is configured to have its bar support leg support the bar above a floor with its bar engagement means removably engaging the bar.

23. The exercise bar of claim 22 wherein the bar engagement means includes a male member configured to fit within the bar strap slot.

24. The exercise bar of claim 22 wherein the bar engagement means includes a sleeve configured to fit at least partially about the outer circumference of the bar.

25. The exercise bar of claim 22 wherein the bar support leg is defined by a closed loop having a handle thereon, whereby the bar support leg defines a grip.

26. The exercise bar of claim 22 wherein the bar support bears a line attachment aperture:

a. having:

(1) an insertion aperture portion, (2) a retention aperture portion, and (3) a throat situated between the insertion and retention aperture portions, surrounded by a closed line attachment aperture inner circumference;

b. configured such that:

(1) the elongated line can freely pass through the insertion aperture portion, the retention aperture portion, and the throat therebetween, and (2) the enlarged line end can pass through the insertion aperture portion, but cannot also pass through the retention aperture portion.

* * * * *